US008613487B2

(12) United States Patent
Iwase et al.

(10) Patent No.: US 8,613,487 B2
(45) Date of Patent: Dec. 24, 2013

(54) LIQUID EJECTION HEAD, CARRIAGE UNIT, PRESSURE CONTROL METHOD, AND LIQUID EJECTION RECORDING APPARATUS

(75) Inventors: Fumiyoshi Iwase, Shizuoka (JP); Tetsuya Murase, Chiba (JP); Masatoshi Toda, Chiba (JP)

(73) Assignees: SII Printek Inc. (JP); Roland DG Corporation (JP)

( * ) Notice: Subject to any disclaimer, the term of this patent is extended or adjusted under 35 U.S.C. 154(b) by 0 days.

(21) Appl. No.: 12/737,777

(22) PCT Filed: Jul. 29, 2009

(86) PCT No.: PCT/JP2009/063519

§ 371 (c)(1),
(2), (4) Date: Apr. 20, 2011

(87) PCT Pub. No.: WO2010/024084

PCT Pub. Date: Mar. 4, 2010

(65) Prior Publication Data

US 2011/0205264 A1 Aug. 25, 2011

(30) Foreign Application Priority Data

Aug. 29, 2008 (JP) ..... 2008-221649

(51) Int. Cl.
*B41J 2/195* (2006.01)
*B41J 29/393* (2006.01)
*B41J 2/175* (2006.01)

(52) U.S. Cl.
CPC ..... *B41J 2/17566* (2013.01); *B41J 2/17596* (2013.01)
USPC ..... 347/7; 347/19; 347/85

(58) Field of Classification Search
CPC . B41J 2/17556; B41J 2/17566; B41J 2/17596
USPC ..... 347/6, 7, 85, 19
See application file for complete search history.

(56) References Cited

U.S. PATENT DOCUMENTS

| | | | | |
|---|---|---|---|---|
| 7,517,032 | B2 * | 4/2009 | Nottelman et al. | 347/85 |
| 8,020,983 | B2 * | 9/2011 | Nishimori | 347/7 |
| 2007/0296744 | A1 * | 12/2007 | Kubota et al. | 347/7 |
| 2008/0273046 | A1 * | 11/2008 | Ishinaga et al. | 347/6 |

OTHER PUBLICATIONS

Patent Abstracts of Japan, publication No. 2006-021383, publication date Jan. 26, 2006.

(Continued)

*Primary Examiner* — Julian Huffman
(74) *Attorney, Agent, or Firm* — Adams & Wilks

(57) ABSTRACT

A liquid jet head has a jetting portion with nozzles for jetting a liquid that is contained in a liquid container. A liquid storing portion is disposed in a conduit that interconnects the liquid storing portion and the jetting portion and that supplies the liquid in a liquid container to the jetting portion through operation of a pump. The liquid storing portion is configured to dampen fluctuations in the pressure in the conduit. A pressure sensor is disposed in the conduit for measuring a pressure in the conduit. The operation of the pump for supplying the liquid in the liquid container to the jetting portion is controlled based on a value of the pressure measured by the pressure measuring means so that the pressure of the liquid supplied from the conduit to the jetting portion is within a predetermined pressure range.

18 Claims, 4 Drawing Sheets

(56) References Cited

OTHER PUBLICATIONS

Patent Abstracts of Japan, publication No. 2007-203641, publication date Aug. 16, 2007.
Patent Abstracts of Japan, publication No. 2000-343723, publication date Dec. 12, 2000.
Patent Abstracts of Japan, publication No. 10-034899, publication date Feb. 10, 1998.
Patent Abstracts of Japan, publication No. 2008-188854, publication date Aug. 21, 2008.
Patent Abstracts of Japan, publication No. 05-084922, publication date Apr. 6, 1993.
Patent Abstracts of Japan, publication No. 2002-241653, publication date Aug. 28, 2002.

* cited by examiner

LIQUID EJECTION HEAD, CARRIAGE UNIT, PRESSURE CONTROL METHOD, AND LIQUID EJECTION RECORDING APPARATUS

CROSS-REFERENCE TO RELATED APPLICATIONS

This application is a U.S. national stage application of International Application No. PCT/JP2009/063519 filed Jul. 29, 2009, claiming a priority date of Aug. 29, 2008, and published in a non-English language.

BACKGROUND OF THE INVENTION

1. Technical Field

The present invention relates to a liquid jet head, a carriage unit, a pressure control method, and a liquid jet recording apparatus.

2. Background Art

Conventionally, as an apparatus for jetting liquid toward a recording medium, there is known a liquid jet recording apparatus for jetting a droplet from a plurality of nozzles toward a recording medium. Some liquid jet recording apparatus, for example, include a liquid jet head mounted thereon for jetting liquid as a droplet of several to several ten picoliters. A liquid jet head which jets such a minute droplet is adapted to control liquid in the nozzle so as to be optimum for being jetted in order to materialize satisfactory jetting of the liquid. Here, a state of liquid which is optimum for being jetted is a state in which the pressure of the liquid in the nozzle is a negative pressure and a meniscus is formed in the nozzle. In order to make such a pressure adjustment, there is known an apparatus in which a pump or an air valve is provided in a flow path of liquid between a liquid container and a liquid jet head for adjusting the pressure of liquid to be supplied to a nozzle.

Here, Patent Literature 1 (PTL) describes an ink jet printer (liquid jet recording apparatus) including a pump for depressurizing liquid in a nozzle of a liquid jet head, an air communication valve for pressurizing liquid in the nozzle of the liquid jet head, a pressure sensor for measuring the pressure of liquid in the nozzle of the liquid jet head, and a control portion for operating the pump and the air communication valve based on a measured value by the pressure sensor. In the ink jet printer, the pressure of liquid to be supplied to the nozzle is adapted to be increased or decreased by the pump and the air communication valve disposed in a liquid flow path from an auxiliary tank for storing liquid to the liquid jet head.

CITATION LIST

Patent Literature

[PTL 1]: JP 2005-34999 A

However, in the ink jet printer described in Patent Literature 1, pressure fluctuations in a nozzle of the liquid jet head which reciprocates at a high speed are large. Therefore, the pressure sensor is required to have a wide measurement range, and further, frequent pressure adjustment is necessary so as to accommodate the pressure fluctuations, and thus, it is difficult to maintain the pressure of the liquid jetted from the liquid jet head at an optimum level.

Further, as an ink jet printer in recent years, a large printing apparatus which can print a large area of a surface of a poster or a signboard is often used, and there is a tendency to enlarge the apparatus in a specific field. In such a large printing apparatus, compared with a case of a small printing apparatus, the distance from a liquid container for storing liquid to be jetted to a liquid jet head is larger, and thus, the length of a flow path for supplying the liquid to the liquid jet head is larger. Therefore, in a large apparatus, the loss of pressure on the liquid in the flow path increases, and the liquid may be prevented from being supplied to the liquid jet head with the pressure thereon being held appropriate for the liquid jet environment. In order to accurately set the pressure value of liquid in the liquid jet head, it is necessary to precisely measure the pressure value in the liquid jet head and to supply the liquid with appropriate pressure thereon being held.

Further, when a carriage including a liquid jet head scans a range to be printed, the position of a flow path for communicating a liquid container with the liquid jet head repeatedly changes as the carriage moves, and hence liquid existing in the flow path is under a pressure load. In this case, liquid affected by the pressure load is supplied to the liquid jet head which is located downstream from the flow path, and thus, it is difficult to hold the appropriate pressure for the liquid jet environment. Normally, such a pressure load on liquid is reduced by a pressure damper (liquid storing portion), however, pressure loss due to the increased length of the flow path still affects the liquid, which prevents materialization of an appropriate printing environment.

Further, as the range to be printed increases as described above, the range to be scanned by the carriage including the liquid jet head also increases, and thus, liquid of an amount beyond the ability of the pressure damper to decrease the pressure load may be supplied to the liquid jet head, and thus, deterioration of the printing environment is expected as the apparatus becomes larger.

As described above, in order to prepare a sophisticated printing environment for a printer, it is an urgent necessity to accurately measure and grasp the pressure of liquid in the liquid jet head.

The present invention has been made in view of the above, and an object of the present invention is to provide a liquid jet head, a carriage unit, a pressure control method, and a liquid jet recording apparatus which can precisely measure the pressure of liquid supplied to a nozzle and which can supply the nozzle with liquid under desired pressure.

SUMMARY OF THE INVENTION

In order to solve the problems described above, the present invention proposes the following techniques.

A liquid jet head according to the present invention includes: a jetting portion having a plurality of nozzles for jetting liquid; a liquid storing portion disposed in a conduit, the conduit being for supplying the liquid in a liquid container via a pump to the jetting portion, the liquid storing portion being for damping pressure fluctuations in the conduit; and pressure measuring means disposed in the conduit connecting the liquid storing portion and the jetting portion, for measuring pressure in the conduit, in which drive control of the pump is exercised based on a measured value by the pressure measuring means so that the pressure of the liquid supplied from the conduit to the jetting portion is in a predetermined range.

According to the present invention, pressure fluctuations of the liquid which flows from the liquid container through the liquid conduit into the liquid storing portion are damped by passage of the liquid through the liquid storing portion. Here, because the pressure measuring means is disposed in the conduit which connects the liquid storing portion and the jetting portion, the pressure of the liquid after being damped by the liquid storing portion is measured by the pressure measuring means. As a result, the pressure of the liquid after being damped by the liquid storing portion can be adjusted.

In the liquid jet head of the present invention, the drive control of the pump is exercised by a pressurizing mechanism and a depressurizing mechanism for pressurizing and depressurizing the liquid in the conduit.

According to the present invention, the liquid is moved toward the jetting portion or toward the liquid container in the conduit by the pressurizing mechanism and the depressurizing mechanism. As a result, the pressure of the liquid in the nozzles can be adjusted.

In the liquid jet head of the present invention, the pressurizing mechanism and the depressurizing mechanism are materialized by a normally rotating mechanism and a reversely rotating mechanism in which the pump normally rotates and reversely rotates, respectively.

According to the present invention, the liquid in the conduit is pressurized or depressurized by rotary drive of the pump, thereby enabling adjustment of the pressure of the liquid in the nozzles by a simple mechanism.

In the liquid jet head of the present invention, the drive control includes a flow path closing mechanism for closing the conduit by stopping operation of the pump to interrupt supply of the liquid from the liquid container to the jetting portion.

According to the present invention, when the pump stops, the movement of the liquid through the conduit is interrupted such that the liquid is stored in the conduit from the pump to the nozzles, thereby simplifying the drive control for maintaining the pressure of the liquid in the nozzles.

In the liquid jet head of the present invention, the pressure measuring means is directly disposed in the conduit which connects the liquid storing portion and the jetting portion.

According to the present invention, because the length of the flow path of the liquid from the jetting portion to the pressure measuring means becomes smaller, the pressure of the liquid in the jetting portion is precisely measured, and at the same time, space occupied by mounting the pressure measuring means can be made smaller.

In the liquid jet head of the present invention, the pressure measuring means is connected to a pressure transmitting conduit which is branched from the conduit which connects the liquid storing portion and the jetting portion.

According to the present invention, it is merely required that the length of the conduit which connects the liquid storing portion and the jetting portion be a length with which the pressure transmitting conduit is connectable, which enables disposition of the liquid storing portion and the jetting portion so as to be in proximity to each other, and at the same time, the flexibility in disposing the pressure measuring means becomes higher.

In the liquid jet head of the present invention, the pressure transmitting conduit is formed of a tube which is flexible and impermeable to gas.

According to the present invention, thickening or solidification of the liquid due to entrance of gas to the inside of the pressure transmitting conduit and thickening or solidification of the liquid due to vaporization of a volatile solvent from the liquid including the volatile solvent and leakage of the volatile solvent from the inside to the outside of the pressure transmitting conduit are suppressed. Accordingly, narrowing of the pressure transmitting conduit by the liquid is suppressed. Further, lowering of the precision of measurement of the pressure sensor caused by attachment of the thickened or solidified liquid to the pressure sensor is suppressed.

In the liquid jet head of the present invention, the pressure transmitting conduit is formed of a metal material.

According to the present invention, usage of a metal material alleviates the effect of a crack due to deterioration caused by aging or the like compared with a case of a tubular member made of a resin, and entrance of fluid, light, or the like to the inside of the pressure transmitting conduit via a wall of the pressure transmitting conduit is suppressed to suppress deterioration of the liquid such as thickening or solidification.

In the liquid jet head of the present invention, the pressure transmitting conduit is formed of a flexible member which suppresses passing of light having a specific wavelength therethrough.

According to the present invention, because passing of light having the specific wavelength through the wall of the pressure transmitting conduit is suppressed, thickening or solidification in the pressure transmitting conduit of the liquid having the property of being cured with light having the specific wavelength is suppressed.

In the liquid jet head of the present invention, the pressure transmitting conduit is detachable from the conduit.

According to the present invention, by detaching the pressure transmitting conduit from the conduit, the inside of the pressure transmitting conduit can be cleaned and the pressure transmitting conduit and the pressure sensor can be replaced.

In another aspect, a carriage unit according to the present invention includes: a jetting portion having a plurality of nozzles for jetting liquid; a liquid storing portion disposed in a conduit, the conduit being for supplying the liquid in a liquid container via a pump to the jetting portion, the liquid storing portion being for damping pressure fluctuations in the conduit; pressure measuring means disposed in the conduit connecting the liquid storing portion and the jetting portion, for measuring pressure in the conduit; and a carriage for supporting the jetting portion, the liquid storing portion, and the pressure measuring means, in which: drive control of the pump is exercised based on a measured value by the pressure measuring means so that the pressure of the liquid supplied from the conduit to the jetting portion is in a predetermined range; and the jetting portion is supported so as to be apart from a recording medium at a predetermined distance and is reciprocated above the recording medium.

According to the present invention, because the liquid storing portion for damping pressure fluctuations of the liquid which accompanies movement of the carriage unit is supported on the carriage and the pressure measuring means is disposed on the side of the jetting portion from the liquid storing portion, the pressure of the liquid after being damped can be measured to adjust the pressure of the liquid even with regard to a liquid jet head which does not have a conduit for connecting the pressure measuring means.

In the carriage unit of the present invention, the drive control is exercised by a pressurizing mechanism and a depressurizing mechanism for pressurizing and depressurizing the liquid in the conduit with the pump.

According to the present invention, the liquid is moved toward the jetting portion or toward the liquid container in the conduit by the pressurizing mechanism and the depressurizing mechanism. As a result, the pressure of the liquid in the nozzles can be adjusted.

In the carriage unit of the present invention, the pressurizing mechanism and the depressurizing mechanism are materialized by a normally rotating mechanism and a reversely rotating mechanism in which the pump normally rotates and reversely rotates, respectively.

According to the present invention, the liquid in the conduit is pressurized or depressurized by rotary drive of the pump, thereby enabling adjustment of the pressure of the liquid in the nozzles by a simple mechanism.

In the carriage unit of the present invention, the drive control includes a flow path closing mechanism for closing the conduit by stopping operation of the pump to interrupt supply of the liquid from the liquid container to the jetting portion.

According to the present invention, when the pump stops, the movement of the liquid through the conduit is interrupted such that the liquid is stored in the conduit from the pump to the nozzles, thereby simplifying the drive control for maintaining the pressure of the liquid in the nozzles.

In the carriage unit of the present invention, a length of the conduit from the pressure sensor to the jetting portion is in a range of 50 mm to 600 mm.

According to the present invention, while, when the length of the conduit from the pressure measuring means to the jetting portion is less than 50 mm, the flexibility in disposing the pressure measuring means is low and it is difficult to dispose the liquid storing portion on the carriage so as to be apart from the jetting portion, because the length of the conduit from the pressure measuring means to the jetting portion is 50 mm or more, the liquid storing portion can be disposed on the carriage so as to be apart from the jetting portion. Further, while, when the length of the conduit from the pressure measuring means to the jetting portion is more than 600 mm, because the amount of pressure fluctuations of the liquid absorbed by the conduit is large, pressure fluctuations in the jetting portion deviate from a pressure value measured by the pressure measuring means, and thus, accurate measurement of the pressure is difficult, because the length of the conduit from the pressure measuring means to the jetting portion is 600 mm or less, the effect of the pressure fluctuations on the precision of jetting the liquid is small. By this, the pressure of the liquid is measured by the pressure measuring means with precision which is enough for the liquid jet head to appropriately jet the liquid.

In the carriage unit of the present invention, the pressure measuring means is disposed in a range of +10 mm to +300 mm in height above the nozzles of the jetting portion.

According to the present invention, if the pressure measuring means is disposed within +10 mm in height from the nozzles of the jetting portion, the position at which the jetting portion is disposed is restricted by the pressure measuring means. On the other hand, because the pressure measuring means is disposed +10 mm or more in height above the nozzles of the jetting portion, the jetting portion and the pressure measuring means do not interfere with each other. Further, if the pressure measuring means is disposed more than +300 mm in height above the nozzles of the jetting portion, because the pressure value measured by the pressure measuring means deviates from the pressure value at the jetting portion by a large amount, precise measurement of the pressure is difficult. On the other hand, because the pressure measuring means is disposed within +300 mm in height from the nozzles of the jetting portion, the difference between the pressure of the liquid measured by the pressure measuring means and the pressure of the liquid in the nozzles can be reduced. As a result, the precision is within a range required for adjusting the pressure of the liquid.

In the carriage unit of the present invention, the liquid storing portion includes a liquid storing chamber formed of a flexible thin-film-like member, and the thin-film-like member suppresses entrance or leakage of gas from outside of the liquid storing portion via the thin-film-like member.

According to the present invention, the liquid storing portion absorbs pressure fluctuations propagating from the liquid conduit with the thin-film-like member. Further, the thin-film-like member suppresses thickening or solidification of the liquid due to entrance of the gas and mixing of air bubbles into the liquid which is jetted from the jetting portion.

In another aspect, a pressure control method using the liquid jet head according to the present invention includes: a step of measuring the pressure of the liquid by the pressure measuring means; a step of determining whether or not the pressure of the liquid is between an upper limit pressure value and a lower limit pressure value which are set in advance; and a step of stopping, by a control portion, driving of the pump when the pressure of the liquid is between the upper limit pressure value and the lower limit pressure value, driving the pump to normally rotate so as to move the liquid toward the jetting portion when the pressure of the liquid is lower than the lower limit pressure value, and driving the pump to reversely rotate so as to move the liquid toward the liquid container when the pressure of the liquid is higher than the upper limit pressure value.

According to the present invention, first, the pressure of the liquid on the side of the jetting portion from the liquid storing portion is measured by the pressure measuring means. Then, the control portion determines whether or not the pressure of the liquid is between the upper limit pressure value and the lower limit pressure value. Here, when the pressure is between the upper limit pressure value and the lower limit pressure value, the control portion stops the pump if the pump is being driven. On the other hand, when the pressure of the liquid is lower than the lower limit pressure value, the pump is driven to send the liquid toward the jetting portion to reduce a negative pressure of the head. Further, when the pressure of the liquid is higher than the upper limit pressure value, the pump is driven to move the liquid toward the liquid container. In this way, the pump is driven by the control portion and the pressure of the liquid while the liquid jet head is jetting the liquid is appropriately adjusted.

A pressure control method of the present invention further includes a correction control step of exercising, by the control portion, correction control with respect to a difference between a pressure value in the nozzles and a pressure value measured by the pressure measuring means.

According to the present invention, by outputting the pressure value of the liquid measured by the pressure measuring means after being corrected at the correction control step into the pressure of the liquid in the nozzles, the pressure value in the nozzles can be adjusted based on the pressure value measured by the pressure measuring means.

In the pressure control method of the present invention, the upper limit pressure value and the lower limit pressure value are set with regard to the pressure value of the liquid in the nozzles.

According to the present invention, because the pressure value of the liquid in the nozzles is controlled to be between the upper limit pressure value and the lower limit pressure value, the pressure of the liquid is adjusted such that the liquid is satisfactorily jetted from the nozzles irrespective of the position at which the pressure measuring means measures the pressure of the liquid.

In the pressure control method of the present invention, the upper limit pressure value is +0.5 kPa and the lower limit pressure value is −2.0 kPa.

According to the present invention, if the upper limit pressure is more than +0.5 kPa, because the liquid leaks from the nozzles of the jetting portion, it is difficult to jet the liquid as a droplet. On the other hand, if the lower limit pressure is less than −2.0 kPa, the liquid is not sufficiently supplied to the nozzles of the jetting portion. By controlling the pressure of the liquid to be in the range of +0.5 kPa to −2.0 kPa, a meniscus surface by the liquid is formed in the nozzles of the jetting portion, and the liquid can be jetted by the jetting portion as a droplet toward the recording medium. Further, by controlling the pressure of the liquid to have a range of +0.5 kPa to −2.0 kPa, excessive drive of the pump caused by frequent change between pressurization control and depressurization control by the control portion is suppressed.

In the pressure control method of the present invention, the upper limit pressure value is −0.5 kPa and the lower limit pressure value is −1.0 kPa.

According to the present invention, because the upper limit pressure value is a negative pressure, a meniscus surface by the liquid is formed in the nozzles, and the liquid can be satisfactorily jetted as a droplet. Further, because the lower limit pressure value is −1.0 kPa, the difference between the upper limit pressure value and the lower limit pressure value is small and fluctuations in the shape of the droplet is suppressed, which leads to a satisfactory result of jetting.

A pressure control method of the present invention further includes a calculating step of calculating, by the control portion, a difference between the pressure of the liquid and the upper limit pressure value or the lower limit pressure value. Driving speed of the pump is changed so as to be proportional to an amount of the difference.

According to the present invention, when the difference is large, by driving the pump at a high speed, the liquid is promptly pressurized or depressurized. Further, when the difference is small, by driving the pump at a low speed, excessive pressurization or depressurization is suppressed.

In another aspect, a liquid jet recording apparatus according to the present invention includes: a liquid jet head according to the present invention; a moving mechanism for reciprocating the jetting portion above a recording medium toward which the liquid is jetted; a transfer mechanism for transferring the recording medium at a predetermined distance from the jetting portion; and a control portion electrically connected to the pressure measuring means and the pump.

According to the present invention, the pressure of the liquid supplied from the liquid container to the liquid jet head is measured by the pressure sensor. Then, the pump is driven by the control portion such that the pressure of the liquid is between the upper limit pressure value and the lower limit pressure value. By this structure and functional arrangement, the pressure fluctuations from the liquid storing portion to the jetting portion are suppressed, and the liquid is precisely jetted from the jetting portion toward the recording medium to land on the recording medium. Further, by relative movement of the liquid jet head and the recording medium by the moving mechanism and the transfer mechanism, the liquid is jetted at a desired position on the recording medium.

According to the liquid jet head, the carriage unit, the pressure control method, and the liquid jet recording apparatus of the present invention, the pressure of the liquid after being damped by the liquid storing portion is measured by the pressure sensor, and the liquid is pressurized or depressurized based on the pressure, and thus, the liquid can be supplied to the jetting portion under optimum pressure conditions.

DESCRIPTION OF EMBODIMENTS

First Embodiment

Figure 1:
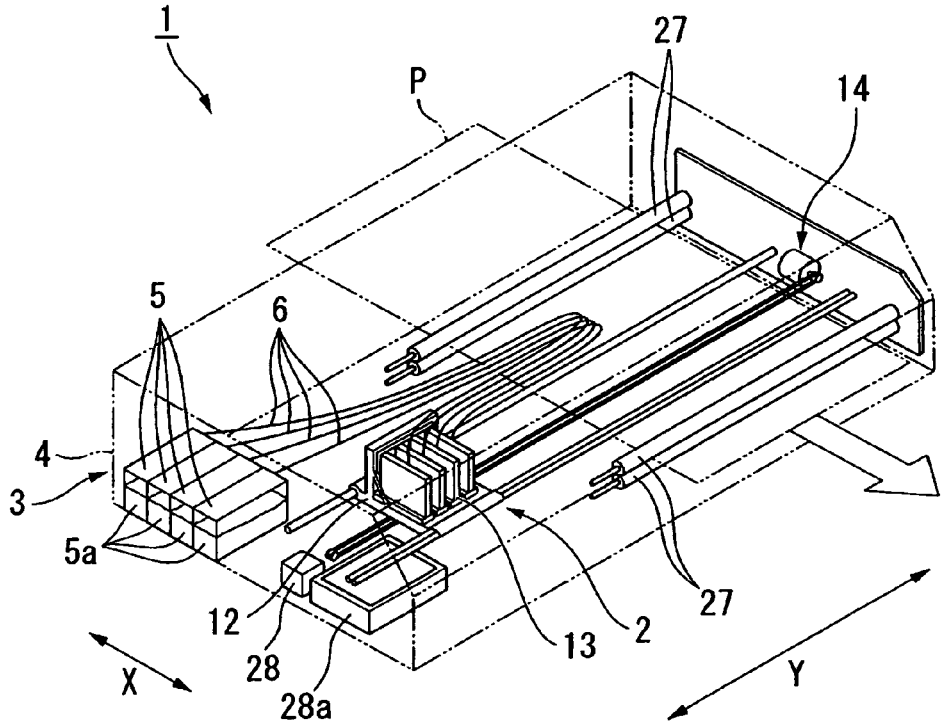
FIG. 1 is an explanatory view for describing a structure of a liquid jet recording apparatus having a liquid jet head according to the present invention mounted thereon.
Figure 2:
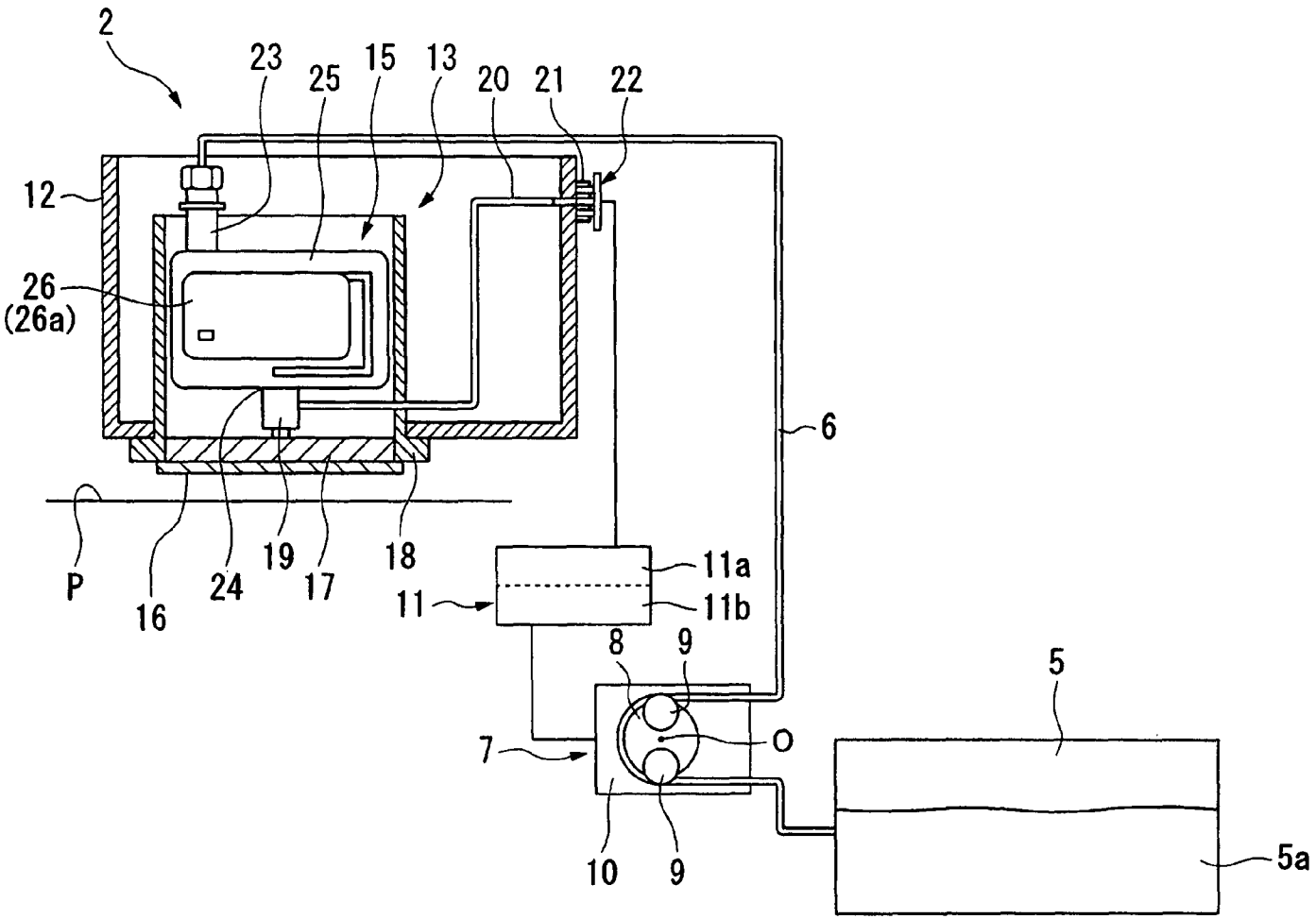
FIG. 2 is an explanatory view illustrating a structure of a flow path of liquid from a liquid container to the liquid jet head according to a first embodiment.
Figure 3:
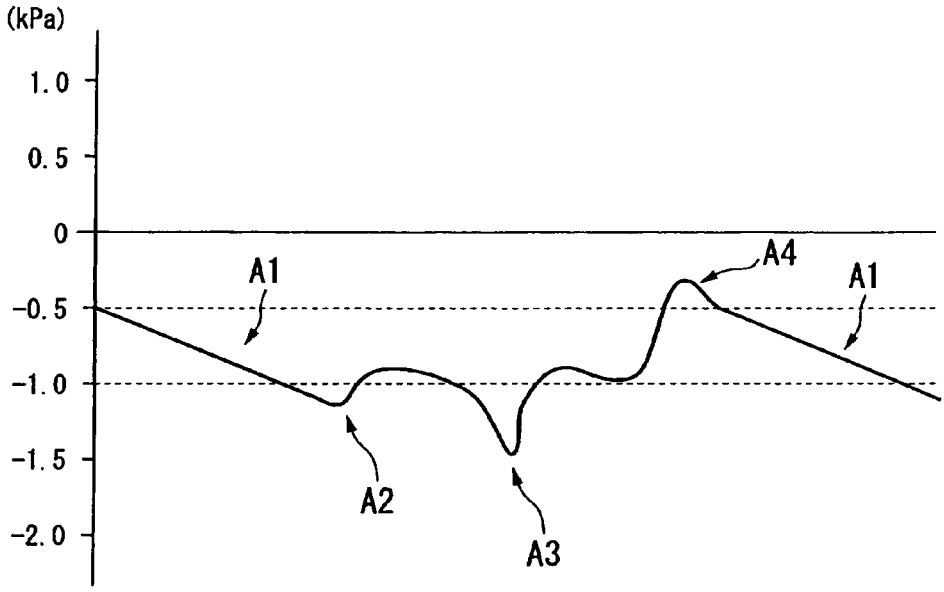
FIG. 3 is an explanatory view for describing operation of liquid pressure control according to the present invention.

A first embodiment of the present invention is described as follows with reference to FIGS. 1 to 3. FIG. 1 is a structural view illustrating a structure of a liquid jet recording apparatus. FIG. 2 is an explanatory view illustrating a structure of a flow path of liquid from a liquid container to a liquid jet head. FIG. 3 is an explanatory view for describing operation of liquid pressure control by the liquid jet recording apparatus.

First, the liquid jet recording apparatus having a liquid jet head mounted thereon according to this embodiment is described.

As illustrated in FIGS. 1 and 2, a liquid jet recording apparatus 1 includes in a chassis 4, a liquid jet mechanism 2 for jetting liquid 5*a* toward a recording medium P such as a paper sheet, a liquid supply mechanism 3 for supplying the liquid 5*a* to the liquid jet mechanism 2, a transfer mechanism 27 for transferring the recording medium P in directions indicated by arrows X in FIG. 1 below the liquid jet mechanism 2, and a control portion 11 electrically connected to the respective mechanisms described above. The liquid supply mechanism 3 includes a liquid container 5 for storing the liquid 5*a*, a flexible tubular liquid conduit 6 having one end connected to the liquid container 5, and a roller tube pump 7 disposed at a middle portion of the liquid conduit 6.

The roller tube pump 7 includes a motor capable of rotating normally and reversely (not shown), a substantially cylindrical wheel 8 having a center of rotation O connected to a drive shaft of the motor as illustrated in FIG. 2, rollers 9 rotatably engaged with an outer peripheral portion of the wheel 8, and a case member 10 having an arc-like groove formed thereon for being engaged with the liquid conduit 6. The rollers 9 are adapted to press a part of the liquid conduit 6 in engagement with the case member 10. Pressurizing mechanism (normally rotating mechanism) and depressurizing mechanism reverse-rotation (reversely rotating mechanism) in the roller tube pump 7 according to this embodiment are described in the following. By pressing the liquid conduit 6 with the rollers 9 while the wheel 8 is normally rotating or reversely rotating, the liquid 5*a* in the liquid conduit 6 is pressurized in the rotational direction of the wheel 8 to send the liquid 5*a* toward or away from the liquid container 5 side. In this embodiment, the roller tube pump 7 is adapted to both send the liquid 5*a* and increase/decrease the pressure. The motor is electrically connected to the control portion 11.

The liquid jet mechanism 2 includes a carriage 12 which is movably disposed above the recording medium P and a liquid jet head 13 fixed to the carriage 12, for jetting the liquid 5*a* toward the recording medium P. The carriage 12 is held by a moving mechanism 14 for reciprocating the carriage 12 in directions indicated by arrows Y in FIG. 1 above the recording medium P.

Further, the liquid jet head 13 includes a liquid storing unit 15 having one end connected to the liquid conduit 6 for damping pressure fluctuations of the liquid 5*a* and passing the liquid 5*a* to another end of the liquid storing unit 15, a jetting portion 17 connected to the another end of the liquid storing unit 15 and having a nozzle surface 16 which has a plurality of nozzles for jetting the liquid 5*a* in minute droplets disposed therein, a first support portion 18 for fixing the liquid storing unit 15 and the jetting portion 17 so as to be in proximity to each other, a branch portion 19 for causing the flow path of the liquid 5*a* to branch between the liquid storing unit 15 and the jetting portion 17, a pressure transmitting conduit 20 having one end connected to the branch portion 19 and formed of a flexible tubular member, and a pressure sensor 22 (pressure measuring means) which has a pressure sensing portion 21 connected to another end of the pressure transmitting conduit 20 and which is fixed to the carriage 12.

The pressure transmitting conduit 20 is formed of a material which suppresses passing of gas therethrough. The pressure sensor 22 is electrically connected to the control portion 11 and measures the pressure value of the liquid 5*a* via gas in the pressure transmitting conduit 20 and sends the measured pressure value to the control portion 11. The liquid storing unit 15 includes a liquid storing case 25 including the communicating portions 23 and 24 connected to the liquid conduit 6 and the branch portion 19, respectively, and a liquid storing portion 26 stored in the liquid storing case 25 and is connected to the communicating portions 23 and 24, respectively. A recess portion is formed in the liquid storing case 25, and by adhering by thermal welding or the like a thin-film-like material for suppressing permeability to gas to a frame portion of the liquid storing case 25 which is a peripheral portion of the recess portion, a liquid storing chamber 26*a* for storing the liquid is formed, thereby forming the above-mentioned liquid storing portion 26. The liquid storing chamber 26*a* in the liquid storing portion 26 communicates with the liquid conduit 6 and the branch portion 19 via the communicating portions 23 and 24, respectively. Such a liquid storing unit 15 makes it possible to adsorb pressure fluctuations accompanying the movement of the liquid jet mechanism 2.

The control portion 11 includes a determining portion 11*a* for monitoring the operation of the pressure sensor 22 and determining whether the pressure is optimum or not and a drive portion 11*b* for driving the roller tube pump 7. In the determining portion 11*a*, an upper limit and a lower limit of the pressure which is optimum for jetting the liquid 5*a* (in this embodiment, the upper limit of the pressure at the nozzle surface 16 is −0.5 kPa while the lower limit is −1.0 kPa) are set, and the pressure measured by the pressure sensor 22 and the set pressure are adapted to be compared with each other.

The drive portion 11*b* is adapted to send a drive signal which drives the roller tube pump 7 to normally rotate, reversely rotate, or stop based on the result of the comparison by the determining portion 11*a*. Normal rotation of the roller tube pump 7 as used hereinafter is in a direction in which the liquid conduit 6 is squeezed from the side of the liquid container 5 to the side of the jetting portion 17, while reverse rotation as used hereinafter is in a direction in which the liquid conduit 6 is squeezed from the side of the jetting portion 17 to the side of the liquid container 5. Further, in this embodiment, normal rotation refers to pressurizing operation while reverse rotation refers to depressurizing operation.

Operation of the liquid jet recording apparatus 1 having the structure described above is now described with reference to FIGS. 1 to 3.

First, an operator supplies the recording medium P to the transfer mechanism 27, and positions the recording medium P below the liquid jet head 13. Then, the liquid 5*a* is jetted from the jetting portion 17 toward the recording medium P while the moving mechanism 14 reciprocates the liquid jet mechanism 2 above the recording medium P, and further, the transfer mechanism 27 moves the recording medium P in a direction orthogonal to the direction of the reciprocation of the liquid jet mechanism 2 in intervals of a certain amount. This makes the liquid 5*a* jetted toward the entire surface of the recording medium P. At this time, the roller tube pump 7 is inactive and the liquid conduit 6 is closed by the rollers 9 (flow path closing mechanism). Therefore, when the liquid 5*a* is jetted, the pressure of the liquid 5*a* in the liquid conduit 6 from the roller tube pump 7 to the jetting portion 17 is decreased (pump stopping step A1 illustrated in FIG. 3).

The pressure of the liquid 5*a* in the liquid jet head 13 is measured by the pressure sensor 22 through the pressure transmitting conduit 20 connected to the branch portion 19. The pressure value of the liquid 5*a* measured by the pressure sensor 22 is sent to the determining portion 11*a* in the form of a signal. In this embodiment, the optimum value is set to have a predetermined range (pressure value at the nozzle surface 16 in this embodiment is in the range of −0.5 kPa to −1.0 kPa).

When the determining portion 11*a* determines that, in the measurement by the pressure sensor 22, the pressure value at the nozzle surface 16 is lower than −1.0 kPa, in response to the determination by the determining portion 11*a*, the drive portion 11*b* is operated to send a drive signal to the roller tube pump 7. Then, the wheel 8 of the roller tube pump 7 rotates, and the rollers 9 operate so as to squeeze the liquid conduit 6 from the liquid container 5 to the side of the jetting portion 17 with the liquid conduit 6 being flattened out.

The determining portion 11*a* continually monitors the pressure value sent from the pressure sensor 22. When it is determined that the pressure value at the nozzle surface 16 indicated by the pressure sensor 22 reaches −1.0 kPa, the drive portion 11*b* stops driving of the roller tube pump 7. In this way, the pressurization is controlled such that the pressure of the liquid 5*a* is in the optimum range (pressurizing step A2 illustrated in FIG. 3).

Further, when it is determined that the pressure at the nozzle surface 16 measured by the pressure sensor 22 is lower than −1.0 kPa which is the lower limit value due to pressure fluctuations caused by the movement of the liquid jet mechanism 2 or the like, the pressurization is controlled in a similar way such that the pressure of the liquid 5*a* at the nozzle surface 16 returns to −1.0 kPa (pressurizing step A3 illustrated in FIG. 3).

On the other hand, when it is determined that the pressure at the nozzle surface 16 measured by the pressure sensor 22 is higher than −0.5 kPa which is the upper limit value due to pressure fluctuations caused by the movement of the liquid jet mechanism 2 or the like, the drive portion 11*b* drives the roller tube pump 7 to reversely rotate, and the liquid 5*a* in the liquid conduit 6 is sent toward the liquid container 5. By this operation, the pressure of the liquid 5*a* in the liquid jet head 13 is decreased. When the determining portion 11*a* determines that the pressure value at the nozzle surface 16 indicated by the pressure sensor 22 is lower than −0.5 kPa, the drive portion 11*a* stops the roller tube pump 7, to thereby control the depressurization (depressurizing step A4 illustrated in FIG. 3).

It is to be noted that, in this embodiment, by including in the control portion 11 a proportional control circuit (not shown) for comparing the pressure value sent from the pressure sensor 22 to the control portion 11 with the upper limit value or the lower limit value and for deciding the rotational speed of the roller tube pump 7 according to the difference therebetween, the rotational speed of the roller tube pump 7 may be, when the difference is large, increased to promptly make an adjustment of the pressure of the liquid 5*a*. As a method of doing so, the proportional control circuit includes a calculating step of calculating the difference based on the pressure value received from the determining portion and a correlation map for correlating the difference with the rotational amount of the roller tube pump 7, and may adopt a method in which a signal specifying the rotational speed of the roller tube pump 7 is output to the drive portion 11*b* in response to input of a pressure value from the determining portion 11*a*, a method in which the driving speed of the roller tube pump 7 is directly calculated in response to input of a pressure value from the determining portion 11*a* and a drive signal to the drive portion 11*b* is generated, or the like.

A filling operation in filling the liquid jet head 13 with the liquid 5*a* is described as follows. When the liquid jet recording apparatus 1 is used for the first time or when the liquid container 5 is replaced, a large amount of gas is mixed in the liquid conduit 6. For this reason, a step of filling the liquid conduit 6 with the liquid 5*a* is carried out. The moving mechanism 14 moves the liquid jet mechanism 2 to a service station 28*a*. The service station 28*a* is adapted to store in a waste liquid tank 28 the liquid 5*a* which leaks from the nozzle surface 16 of the jetting portion 17.

Next, the roller tube pump 7 is driven by the drive portion 11*b*. Then, a negative pressure is generated in the liquid conduit 6 on the side of the liquid container 5 from the roller tube pump 7, and the liquid 5*a* is drawn from the liquid container 5 to be supplied via the roller tube pump 7 to the jetting portion 17. When the liquid 5*a* is supplied to the jetting portion 17 and the liquid conduit 6 is filled with the liquid 5*a*, the drive portion 11*b* stops the roller tube pump 7.

Next, the determining portion 11*a* monitors the pressure value indicated by the pressure sensor 22, and whether the pressure of the liquid 5*a* in the branch portion 19 is an optimum value or not is determined. When the pressure value indicated by the pressure sensor 22 is outside the optimum range, the determining portion 11*a* calculates the difference between the pressure value indicated by the pressure sensor 22 and the optimum range, the drive portion 11*b* drives the roller tube pump 7 such that the difference is reduced in response to the determination by the determining portion 11*a*, and, when it is determined that the pressure value indicated by the pressure sensor 22 is in the optimum range, driving of the roller tube pump 7 is stopped. After that, a liquid jet recording step may start.

As described above, according to the liquid jet head 13 of this embodiment, the pressure of the liquid 5*a* damped by the liquid storing unit 15 is transmitted from the liquid storing unit 15 to the pressure sensor 22 connected via the pressure transmitting conduit 20 which is disposed between the liquid storing unit 15 and the jetting portion 17, and, when the pressure is insufficient or excessive, the control portion 11 drives the roller tube pump 7 in response to the value measured by the pressure sensor and the liquid 5*a* in the liquid conduit 6 is sent until the pressure is in the optimum range.

With such a structure, the liquid jet apparatus according to this embodiment can, even when the length of the flow path is long and pressure loss in the flow path increases, measure the pressure value of the liquid 5*a* at the nozzle surface 16, and thus, the liquid 5*a* can be supplied with the pressure which is held appropriate.

Further, because the liquid storing unit 15 is included, pressure fluctuations of the liquid 5*a* accompanying movement of the carriage 12 can be reduced. Further, as described above, by measuring the pressure of the liquid 5*a* existing between the liquid storing unit 15 and the nozzle surface 16, the measurement can be carried out with respect to the liquid the pressure fluctuations of which are reduced by the liquid storing unit 15. By this, even when the effect of pressure loss due to the lengthened flow path or the effect of pressure fluctuations accompanying movement of the liquid jet mechanism 2 remains, the pressure of the liquid 5*a* at the nozzle surface 16 can be measured, and thus, an appropriate printing environment can be prepared.

Further, because the pressure transmitting conduit 20 according to this embodiment is formed of a material which suppresses passing of gas therethrough, entrance of outside air through the wall thereof into the liquid 5*a* which flows from the branch portion 19 in the pressure transmitting conduit 20 is suppressed. This suppresses thickening, solidification, or alteration (hereinafter, collectively referred to as deterioration) of the liquid 5*a*, and attachment of the liquid 5*a* which is deteriorated to the pressure sensing portion 21 of the pressure sensor 22 and lowering of the precision of jetting the liquid due to partial or complete closing of the flow path of the liquid 5*a* to the jetting portion 17 are suppressed.

Further, the pressure transmitting conduit 20 is detachable at the branch portion 19, which enables independent cleaning of the pressure transmitting conduit 20 through which it is difficult to pass cleaning liquid, when the flow path of the liquid 5*a* from the liquid container 5 to the jetting portion 17 is cleaned.

Further, the pressure transmitting conduit 20 is connected to the branch portion 19 formed in a part of the flow path of the liquid 5*a* on the side of the jetting portion 17 from the liquid storing unit 15. The liquid storing unit 15 absorbs pressure fluctuations caused in the liquid conduit 6 on the side of the liquid container 5 by the liquid storing portion 26 to damp the range of the pressure fluctuations. Therefore, a pressure having the damped range of fluctuations is transmitted to the branch portion 19 and is measured by the pressure sensor 22 via the pressure transmitting conduit 20. Further, because the length of the flow path of the liquid 5*a* from the branch portion 19 to the jetting portion 17 is small, the difference between the pressure measured by the pressure sensor 22 and the pressure of the liquid 5*a* supplied to the nozzle surface 16 can be reduced.

Further, the pressure control method for the liquid 5*a* with the structure according to this embodiment is carried out by pressurizing or depressurizing the liquid 5*a* in the liquid conduit 6 by the roller tube pump 7. Therefore, compared with a conventional technology of controlling the pressure of the liquid 5*a* by introducing gas into the liquid container 5, deterioration of the liquid 5*a* due to exposure of the liquid 5*a* to the gas is suppressed, and the liquid can be jetted satisfactorily.

Further, according to the present invention, the optimum value for jetting the liquid 5*a* from the jetting portion 17 is set to have a predetermined range (the pressure value at the nozzle surface 16 is in the range of −0.5 kPa to −1.0 kPa in this embodiment). If a single value is set as the optimum pressure, when, during a very small time lag from when the optimum value is indicated by the pressure sensor 22 to when the control portion 11 receives the pressure value and the roller tube pump 7 is stopped, the roller tube pump 7 pressurizes or depressurizes the liquid 5*a* and the pressure deviates from the optimum value in the opposite direction, frequent control may be exercised in order to decrease such minute pressure fluctuations. According to the present invention, the optimum value has a range and a mechanism to stop the roller tube pump 7 in the case of minute pressure fluctuations around the optimum value is adopted, and hence the above-mentioned frequent control is not exercised.

In the following, as a modified example of the drive control of the roller tube pump 7, correction control for correcting the difference between the pressure value measured by the pressure sensing portion 21 of the pressure sensor 22 and the pressure at the nozzle surface 16, due to the difference in height between the branch portion 19 and the nozzle surface 16, is described in detail.

Because the position of the branch portion 19 and the position of the nozzle surface 16 are different in height even if the difference may be minute, there is a possibility that the pressure value in the branch portion 19 and the pressure value at the nozzle surface 16 are different. In order to solve this problem, in this modified example, the control portion 11 includes correction control (correction control step A5) for correcting the pressure value measured by the pressure sensing portion 21 such that the pressure value at the nozzle surface 16 is an appropriate pressure value.

The correction control (correction control step A5) is exercised with a correction table (not shown) in the determining portion 11*a* of the control portion 11, in which a correlation between the pressure measured by the pressure sensor 22 and the pressure at the nozzle surface 16 is set. The determining portion 11*a* is adapted to determine whether the pressure value at the nozzle surface 16 is in the optimum range or not by referring to the correction table and converting the pressure value measured by the pressure sensor 22 to the pressure value at the nozzle surface 16.

The drive portion 11*b* is adapted to drive the roller tube pump 7 by sending to the roller tube pump 7 a drive signal corresponding to the determination by the determining portion 11*a* based on the pressure value after being converted.

It is to be noted that, in this modified example, the setting may be that a corrected value is measured in advance based on the structure of the liquid jet head 13 and the corrected value is used by the determining portion 11*a* from the beginning.

Second Embodiment

Next, a liquid jet recording apparatus according to a second embodiment of the present invention is now described with reference to FIG. 4. It is to be noted that, in the embodiment described in the following, common numerals and symbols are used to designate identical members in the structure of the first embodiment described above and description thereof is omitted.

Figure 4:
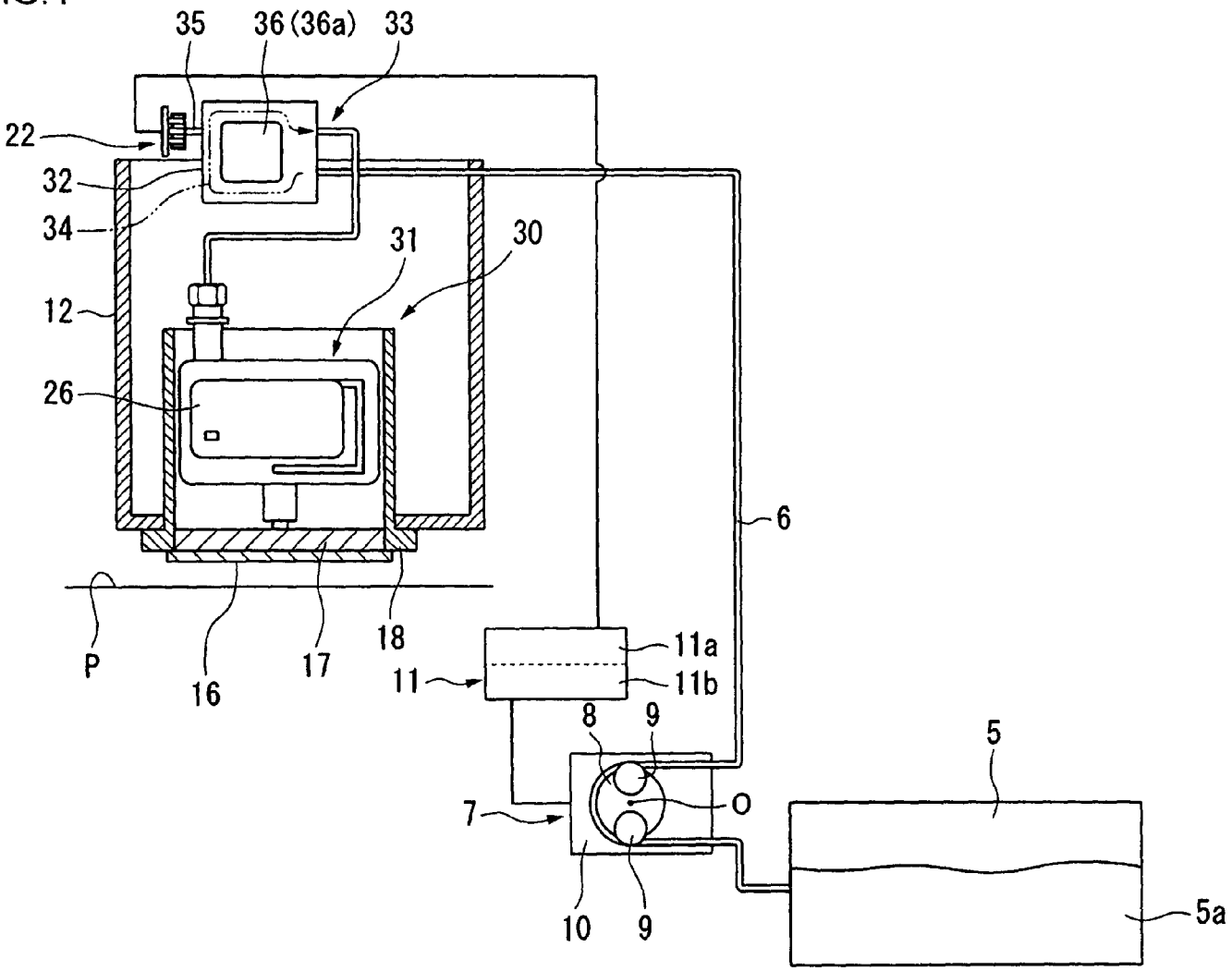
FIG. 4 is an explanatory view for describing a structure of a flow path of liquid in a liquid jet recording apparatus according to a second embodiment of the present invention.

FIG. 4 is an explanatory view for describing a structure of a flow path of liquid in the liquid jet recording apparatus according to the second embodiment of the present invention.

A liquid storing unit 31 of a liquid jet head 30 according to this embodiment is a conventional liquid storing unit having no branch tube included therein. A part of the carriage 12 is a second support portion 32 to which a liquid storing unit 33 including the pressure sensor 22 is fixed. In this embodiment, a carriage unit 28 includes the liquid jet head 30, the carriage 12, the liquid storing units 31 and 33, and the pressure sensor 22. Further, this embodiment is different from the first embodiment in that a branch portion 35 is formed at a liquid storing case 34 and is connected to the pressure sensor 22. Because the branch portion 35 opens on the side of the jetting portion 17 from a liquid storing portion 36 of the liquid storing unit 33, pressure after being damped by the liquid storing unit 33 is transmitted to the pressure sensor 22. Further, the liquid storing portion 36 includes a liquid storing chamber 36*a* which is structured similarly to the liquid storing chamber in the first embodiment.

Further, the liquid storing unit 33 is disposed in a part of the liquid conduit 6 which is a middle portion between the roller tube pump 7 and the liquid storing unit 31. Here, the length of the flow path of the liquid 5*a* from the liquid storing unit 33 to the jetting portion 17 is adjusted to be in the range of 50 mm to 600 mm which are optimum values of a liquid supply flow path according to this embodiment.

In the second embodiment, in the liquid jet head 30 which can not include the pressure sensor 22 in the flow path of the liquid 5*a* from the liquid storing unit 31 to the jetting portion 17, by newly disposing the liquid storing unit 33 on the side of the carriage unit 28 of the liquid conduit 6 between the roller tube pump 7 and the jetting portion 17, and further, by disposing the pressure sensor 22 in the flow path of the liquid 5*a* from the liquid storing unit 33 to the jetting portion 17, similarly to the case of the first embodiment, the pressure of the liquid 5*a* after being damped by the liquid storing unit 33 can be measured. In the second embodiment, similarly to the case of the first embodiment, the control portion 11 monitors the pressure value measured by the pressure sensor 22. When the value deviates from the range between the lower limit pressure value and the upper limit pressure value, the roller tube pump 7 is driven to pressurize or depressurize the liquid 5*a*, thereby adjusting the pressure of the liquid 5*a* supplied to the liquid jet head 30.

Further, because the measurement position of the pressure sensor 22 is the position of the liquid storing unit 33, compared with the case of the first embodiment, the pressure of the liquid 5*a* is measured at a place which is farther from the nozzle surface 16. In this case, there is a possibility that a measurement difference is generated between the pressure value of the liquid 5*a* at the nozzle surface 16 and the measured value of the liquid 5*a* in the liquid storing unit 33. In such a case, similarly to the case of the first embodiment, by correcting the pressure value measured by the pressure sensor 22, the pressure of the liquid 5*a* at the nozzle surface 16 can be maintained in the optimum range.

Further, the second embodiment is different from the first, embodiment with regard to the structure in that the pressure value in the liquid storing portion 36 of the liquid storing unit 33 is measured. The liquid 5*a* is stored in the liquid storing portion 36, and, compared with measurement in the flow path or in the conduit, measurement in the liquid storing portion 36 involves less amount of displacement of the liquid 5*a* and less fluctuations of the pressure value. More specifically, because such a structure is adopted in the second embodiment, the pressure sensor 22 measures the pressure value in a place in which the liquid 5*a* is stored, and thus, fluctuations of the measured pressure value and the possibility of including noises in the pressure value can be reduced. Therefore, in the second embodiment, the pressure value of the liquid 5*a* can be measured with stability.

Embodiments according to the present invention are described above in detail with reference to the attached drawings. However, specific structures are not limited thereto and various modifications including design changes can be made without departing from the gist of the present invention.

For example, in the embodiments according to the present invention, the target value of the pressure at the nozzle surface 16 which is controlled by the control portion 11 is optimum when the value is −0.5 kPa to −1.0 kPa, but the precision of the jetting of the liquid 5*a* may be satisfied also when the target value is set to be +0.5 kPa to −2.0 kPa. In this case, by extending the range of the target value, the frequency of driving the roller tube pump 7 for adjusting the pressure can be decreased.

Further, although, in the embodiments according to the present invention, the adopted structure of the roller tube pump 7 is such that the liquid conduit 6 is disposed on the outer periphery of the wheel 8 and pressed by the rollers 9, the present invention is not limited thereto. For example, a middle portion of a flexible tubular member may be disposed along a part of the outer periphery of the wheel and pressed by the rollers, with a roller tube pump having both ends opened as connecting openings being in the middle portion of the liquid conduit 6.

Further, although, in the embodiments according to the present invention, a roller tube pump having two rollers 9 is adopted as the pump for pressurizing or depressurizing the liquid 5*a* in the liquid conduit 6, the present invention is not limited thereto. A roller tube pump having more than two rollers 9 may be adopted, or a pump mechanism other than the roller tube pump may pressurize or depressurize the liquid 5*a* in the liquid conduit 6.

Further, although, in the embodiments of the present invention, the liquid container 5 is adopted as the container of the liquid, the present invention is not limited thereto. For example, a liquid supply mechanism including a main tank for containing a relatively large amount of liquid and an auxiliary tank connected via a tubular member to the main tank for containing part of the liquid contained in the main tank may be adopted.

Further, although, in the first embodiment of the present invention, the pressure sensor 22 measures the pressure value from the branch portion 19 via the pressure transmitting conduit 20, a pressure measuring chamber in which the liquid 5*a* is stored may be provided in proximity to the pressure sensing portion 21 of the pressure sensor 22. By adopting such a structure, even in the first embodiment, the stability in measuring the pressure value of the liquid 5*a* can be enhanced.

Further, although, in the first embodiment of the present invention, the adopted structure is such that the pressure transmitting conduit 20 is formed of a tubular flexible member which suppresses entrance of gas, the present invention is not limited thereto, and a member which is formed of a different material may be used according to the properties of the liquid 5*a* which fills the pressure transmitting conduit or the like. For example, when a tubular member made of a metal such as stainless steel or aluminum is adopted as the pressure transmitting conduit, the durability of the pressure transmitting conduit is enhanced, and entrance of gas into the inside of the pressure transmitting conduit through a crack due to deterioration caused by aging or the like is suppressed. Further, when a structure is adopted in which the pressure transmitting conduit is coated with a light-blocking coating or the pressure transmitting conduit is formed of a light-blocking material, passing of light through the pressure transmitting conduit to the inside is suppressed. Therefore, curing or alteration of the liquid 5*a* by ultraviolet radiation and visible radiation is suppressed.

Further, although, in the second embodiment of the present invention, the adopted structure is such that the pressure sensor is directly fixed to the liquid storing unit 33, it is merely required that the position be such that the pressure of the liquid 5*a* after pressure fluctuations thereof are damped by the liquid storing unit 33 is measured. For example, the pressure sensor 22 may be connected to the branch portion 35 via the pressure transmitting conduit 20, or a branch portion may be newly provided in a part of the flow path of the liquid 5*a* from the liquid storing unit 33 to the jetting portion 17 and the pressure sensor 22 may be connected to a tip of the branch portion.

Further, although, in the second embodiment of the present invention, the adopted structure is such that the liquid storing unit 31 is mounted in advance on the liquid jet head 30, the present invention is not limited thereto, and the liquid storing unit 33 and the pressure sensor 22 according to the present invention may be disposed in a liquid jet recording apparatus with a liquid jet head not having the liquid storing unit 31 mounted thereon. Also in this case, the pressure of the liquid 5*a* after the pressure fluctuations thereof are damped by the liquid storing unit 33 can be measured to make a pressure adjustment.

REFERENCE SIGNS LIST

1 liquid jet recording apparatus
5 liquid container
5*a* liquid
6 liquid conduit (conduit)
7 roller tube pump (pump)
11 control portion
12 carriage
13, 30 liquid jet head
14 moving mechanism
16 nozzle surface
17 jetting portion
19, 35 branch portion
20 pressure transmitting conduit
22 pressure sensor (pressure measuring means)
26, 36 liquid storing portion
23*a*, 36*a* liquid storing chamber
27 transfer mechanism
28 carriage unit
A1 pump stopping step
A2, A3 pressurizing step
A4 depressurizing step
A5 correction control step
P recording medium

The invention claimed is:

1. A liquid jet head, comprising:

a jetting portion having a plurality of nozzles for jetting a liquid that is contained in a liquid container;

a liquid storing portion disposed in a conduit that interconnects the liquid storing portion and the jetting portion and that supplies the liquid in the liquid container to the jetting portion through operation of a pump, the liquid storing portion being configured to dampen pressure fluctuations in the conduit; and pressure measuring means disposed in the conduit at a position downstream of the liquid storing portion for measuring pressure in the conduit after the liquid storing portion dampens pressure fluctuations in the conduit, the operation of the pump for supplying the liquid in the liquid container to the jetting portion being controlled based on a value of the pressure measured by the pressure measuring means so that the pressure of the liquid supplied from the conduit to the jetting portion is within a predetermined pressure range.

2. A liquid jet head according to claim 1; wherein the operation of the pump based on the value of the pressure measured by the pressure measuring means is controlled by a pressurizing mechanism and a depressurizing mechanism for pressurizing and depressurizing, respectively, the liquid in the conduit.

3. A liquid jet head according to claim 2; wherein the pressurizing mechanism and the depressurizing mechanism comprise a rotating mechanism for rotating the pump in respective first and second opposite directions of rotation.

4. A liquid jet recording apparatus comprising: the liquid jet head according to claim 1; the pump configured to undergo an operation to effect the supply of the liquid in a liquid container to the jetting portion; and a control portion for controlling the pump operation, the control portion comprising a flow path closing mechanism for closing the conduit by a stopping operation of the pump so as to interrupt the supply of the liquid contained in the liquid container to the jetting portion.

5. A liquid jet head according to claim 1; wherein the pressure measuring means is directly disposed in the conduit.

6. A liquid jet head according to claim 1; wherein the pressure measuring means is connected to a pressure transmitting conduit which is branched from the conduit.

7. A liquid jet head according to claim 6; wherein the pressure transmitting conduit is formed of a tube which is flexible and impermeable to gas.

8. A liquid jet head according to claim 6; wherein the pressure transmitting conduit is formed of a metal material.

9. A liquid jet head according to claim 6; wherein the pressure transmitting conduit is formed of a flexible member which suppresses the passing therethrough of light having a specific wavelength.

10. A liquid jet head according to claim 6; wherein the pressure transmitting conduit is detachable from the conduit.

11. A liquid jet recording apparatus comprising:

a liquid jet head according to claim 1;

a moving mechanism for reciprocating the jetting portion above a recording medium toward which the liquid is jetted;

a transfer mechanism for transferring the recording medium at a predetermined distance from the jetting portion; and a control portion electrically connected to the pressure measuring means and the pump for controlling an operation of the pump.

12. A carriage unit, comprising:

a jetting portion having a plurality of nozzles for jetting a liquid that is contained in a liquid container;

a liquid storing portion disposed in a conduit that interconnects the liquid storing portion and the jetting portion and that supplies the liquid in the liquid container to the jetting portion through operation of a pump, the liquid storing portion being configured to dampen pressure fluctuations in the conduit;

pressure measuring means disposed in the conduit at a position downstream of the liquid storing portion for measuring pressure in the conduit after the liquid storing portion dampens pressure fluctuations in the conduit, the operation of the pump for supplying the liquid in the liquid container to the jetting portion being controlled based on a value of the pressure measured by the pressure measuring means so that the pressure of the liquid supplied from the conduit to the jetting portion is within a predetermined pressure range; and a carriage for supporting the jetting portion, the liquid storing portion, and the pressure measuring means, the jetting portion being supported by the carriage so as to be apart from a recording medium at a predetermined distance and for undergoing reciprocal movement above the recording medium.

13. A carriage unit according to claim 12; wherein the operation of the pump based on the value of the pressure measured by the pressure measuring means is controlled by a pressurizing mechanism and a depressurizing mechanism for pressurizing and depressurizing, respectively, the liquid in the conduit.

14. A carriage unit according to claim 13; wherein the pressurizing mechanism and the depressurizing mechanism comprise a rotating mechanism for rotating the pump in respective first and second opposite directions of rotation.

15. A liquid jet recording apparatus comprising:

the carriage unit according to claim 12, the pump being configured to undergo an operation to effect the supply of the liquid in a liquid container to the jetting portion, and the conduit interconnecting the liquid storing portion and the jetting portion and supplying the liquid in a liquid container to the jetting portion through operation of the pump, a length of the conduit from the pressure measuring means to the jetting portion being in a range of 50 mm to 600 mm.

16. A carriage unit according to claim 12; wherein the pressure measuring means is disposed in a range of +10 mm to +300 mm in height above the plurality of nozzles of the jetting portion.

17. A carriage unit according to claim 12; wherein the liquid storing portion comprises a liquid storing chamber formed of a flexible thin-film-like member that suppresses entrance or leakage of a gas from outside of the liquid storing portion via the thin-film-like member.

18. A liquid jet recording apparatus comprising:

a carriage unit according to claim 12;

a moving mechanism for reciprocating the jetting portion above a recording medium toward which the liquid is jetted;

a transfer mechanism for transferring the recording medium at a predetermined distance from the jetting portion; and a control portion electrically connected to the pressure measuring means and the pump for controlling an operation of the pump.

* * * * *